US005853493A

United States Patent [19]

Skelton et al.

[11] Patent Number: 5,853,493

[45] Date of Patent: Dec. 29, 1998

[54] CLEANING OF INDUSTRIAL FABRICS USING CRYOBLASTING TECHNIQUES

[75] Inventors: John Skelton, Sharon, Mass.; Salvatore Panarello, Sewell, N.J.; Dana Burton Eagles, Sherborn, Mass.

[73] Assignee: Albany International Corp., Albany, N.Y.

[21] Appl. No.: 916,617

[22] Filed: Aug. 22, 1997

[51] Int. Cl.[6] ..... B08B 7/00

[52] U.S. Cl. ..... 134/7; 8/147; 8/151; 451/39

[58] Field of Search ..... 134/7; 451/39, 451/53; 8/147, 151

[56] References Cited

U.S. PATENT DOCUMENTS 4,744,181 5/1988 Moore et al. ..... 134/7 X 4,947,592 8/1990 Lloyd et al. ..... 134/7 X 5,109,636 5/1992 Lloyd et al. ..... 451/39

FOREIGN PATENT DOCUMENTS 0014927 12/1990 WIPO ..... 451/39

*Primary Examiner*—Philip R. Coe

*Attorney, Agent, or Firm*—Kane, Dalsimer,Sullivan, Kurucz, Levy, Eisele and Richard, LLP

[57] ABSTRACT

The present invention provides a method of removing contaminants from industrial process fabrics relying upon cryogenic techniques, wherein the fabric is impacted with solid particles of carbon dioxide. A cryoblaster projects the carbon dioxide particles at the fabric. The cryoblaster scans over the entirety of the fabric at a scanning rate particle velocity, and particle flow rate in order to insure that the fabric is cleaned without suffering any damage.

10 Claims, 14 Drawing Sheets

CLEANING OF INDUSTRIAL FABRICS USING CRYOBLASTING TECHNIQUES

FIELD OF THE INVENTION

The present invention is directed towards the cleaning of industrial fabrics using cryoblasting techniques. "Industrial Fabrics" as used herein, includes but is not limited to fabrics used in the production of wet laid (paper and paper-related) products and dry laid (melt, blown, spunbond, dry laid cellulosics, non-wovens, etc.) products.

BACKGROUND OF THE INVENTION

While industrial fabrics generally come in a wide variety of styles, many can generally be characterized as formed from a woven pattern of warp and shute yarns, which extend in the machine and cross machine direction. In another variant, fabrics are joined of spirally wound fibers. Some industrial fabrics have a single layer while others are multi-layered, wherein the several layers are bound together by binder fibers woven among the several layers.

The industrial fabrics described above have literally thousands of interstices formed between the yarns. During the life of the fabric, materials used in the paper making process and paper related processes contaminate the fabric by collecting on the surface of the fabric and clogging the interstices. Materials which contaminate industrial fabrics used to make wet laid and dry laid products include cellulosic fibers, synthetic staple fibers, latex adhesives, olefinic polymer deposits, resin, pitch, tar, fillers, extenders, and starch residues, among others.

The adverse effect of these contaminants cannot be underestimated, since the primary function of industrial fabrics is to provide a medium to form, convey, and produce continuous paper, paper-related products, and non-woven products from fibrous raw materials. The fabric must maintain an acceptable degree of openness, which is something that diminishes with the accumulation of contaminants over the life of the fabric. Contamination reduces the performance and useful life of a fabric. Removal of contaminants could therefore have a beneficial effect in improving the useful life of industrial fabrics used to produce wet laid and dry laid products.

Cryoblasting is a process of cleaning surfaces of materials with carbon dioxide in its solid form. While it is analogous to sandblasting, cryoblasting has two distinct advantages over traditional sandblasting. First, the particles of solid carbon dioxide evaporate (or more precisely, sublime) after impacting against the surface. Impacting the surface with particles of solid carbon dioxide physically dislodges and removes contaminants, carrying the contaminants away from the fabric surface for collection at a remote site. These removed contaminants include both solids and liquids. After the solid carbon dioxide sublimes the collected contaminant consists solely of the solids and liquids removed from the fabric surface. The only residue is the liquid or solid removed from the surface of the object. Second, cryoblasting is believed to have chemical cleaning action in addition to mechanical cleaning action. Supercritical carbon dioxide is known to have solvent properties similar to chemical solvents such as hexane, i.e., nonpolar solvents. While not wishing to be bound by any theory, it is believed that at the sight of pellet impact, the local pressure on the solid carbon dioxide pellet causes the formation of supercritical carbon dioxide. This condition is believed to create a local nonpolar environment which has been found to be particularly effective in solubilizing and removing nonpolar residues such as oil and tar residues from surfaces.

Cryoblasting is practiced by two methods. One method uses compressed gas to accelerate particles of solid carbon dioxide. The second method uses a mechanical device to accelerate particles of solid carbon dioxide. The mechanical cryoblasting method was developed at Oak Ridge National Laboratory (ORNL). This method is reportedly more cost effective than the compressed gas method. Cost savings result from lower capital cost for equipment and more efficient use of solid carbon dioxide.

U.S. Pat. Nos. 5,109,636, 4,947,592 and 4,744,181 disclose a particle blast cleaning apparatus and method using solid carbon dioxide.

U.S. Pat. No. 5,108,512 discloses a process for the cleaning of the inner surfaces of a chemical vapor deposition reactor used in the production of semi-conductor grade polycrystalline silicon. The process comprises impacting the surfaces to be cleaned with solid carbon dioxide pellets. The carbon dioxide pellets dislodge silicon deposits from the surface of the reactor without damaging the surface of the reactor and without providing a source for contamination of semi-conductor grade silicon produced in the cleaned reactor.

Generally, the prior art procedures utilizing solid particles of carbon dioxide are directed to the cleaning of hard, durable materials such as steel and concrete. In spite of the durability of such materials, the particle velocities and particle hardness have been found to damage those materials.

SUMMARY OF THE INVENTION

The object of the present invention is to provide a method of removing contaminants from industrial fabrics using solid particles of carbon dioxide.

It is a further object of the invention, given the particle velocities and particle hardness, to develop operating parameters that permit the fabric to be cleaned while minimizing fabric damage.

The applicants have developed operating conditions that clean the fabric without damaging it. The method of cleaning an industrial fabric comprises impacting the fabric with solidified and pelletized carbon dioxide produced by a cryoblaster which projects the carbon dioxide pellets at the fabric. The cryoblaster can be scanned over the entirety of the fabric at a preselected scanning rate and at a preselected rate of projection in order to insure that the fabric is cleaned without damaging it. Alternatively, it could be scanned over selected regions of the fabric in order to spot clean portions of the fabric.

DETAILED DESCRIPTION OF THE PREFERRED EMBODIMENT

Figure 1:
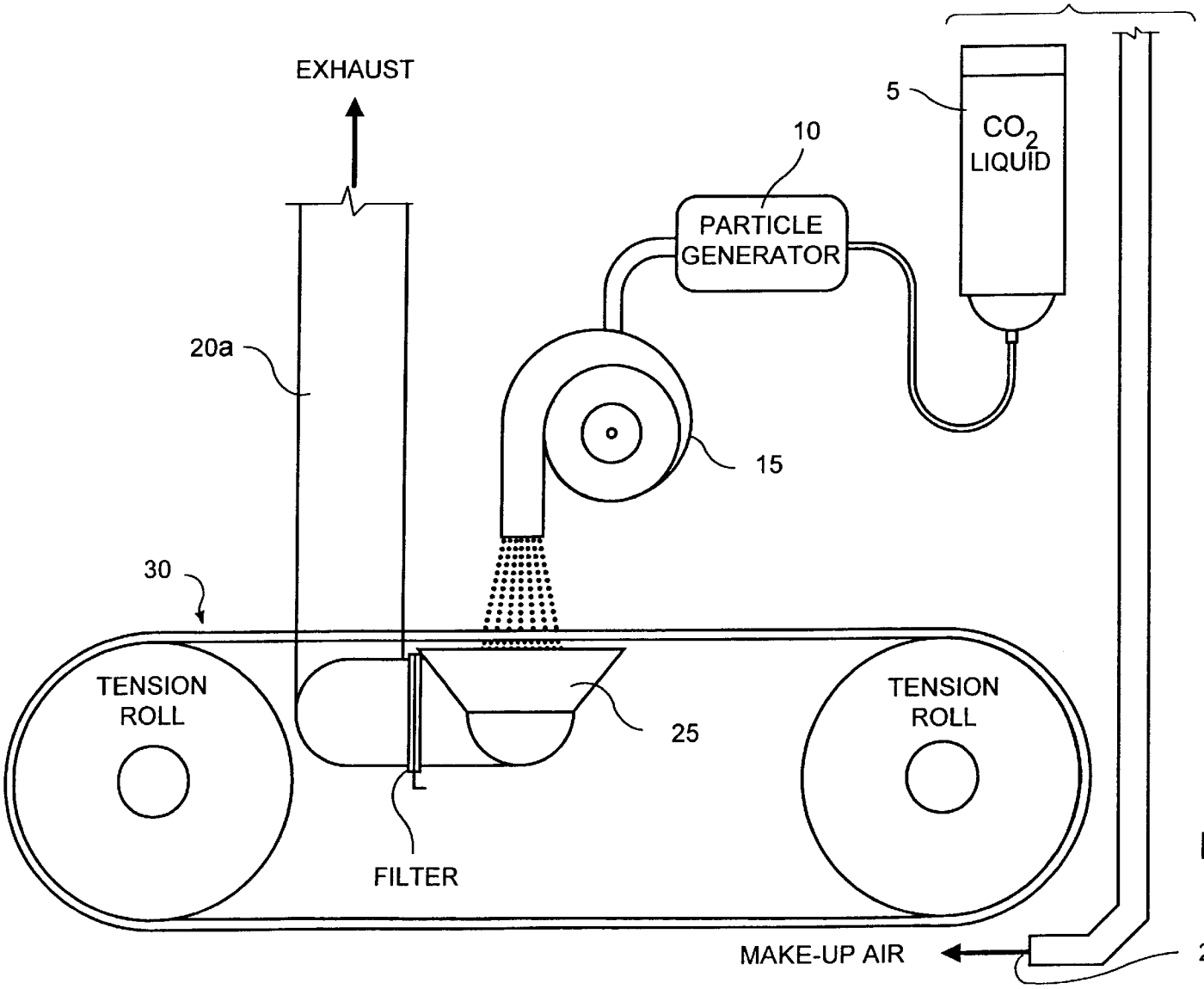
FIG. 1 is a schematic diagram of the cryoblaster of the preferred embodiment.

The cryoblaster used in the preferred embodiment of the present invention consists of two primary elements. One element is the accelerator which consists of a disk twenty-two (22) inches in diameter which rotates at speeds of 4,000 to 12,000 rpm. The rotating disk contains grooves similar in appearance to the vanes on the wheel of a centrifugal pump. Solid $CO_2$ particles are introduced near the center of the rotating disk. The rotation of the disk causes the particles to move outward towards the edge of the disk. Once the particles reach the edge of the disk, they are thrown at a velocity corresponding to the tangential velocity for the outer diameter of the disk. For a 22-inch diameter disk, the velocity is 1,150 feet per second at 12,000 rpm. At 6,000 rpm, the velocity is proportionally lower and corresponds to 575 feet per second. See Haines, J. R., "Solvent Free Cleaning using a Centrifugal Cryogenic Pellet Accelerator", which is incorporated herein by reference.

The second element of the cryoblaster consists of a pelletizing device which converts liquid carbon dioxide into solid carbon dioxide pellets. This device is fed with liquid carbon dioxide which is stored in a tank at 0° C. under pressure of about 300 psi. As the $CO_2$ exits the tank and enters the chamber, it expands and forms a pelletized "snow".

The cryoblaster has the capability of delivering solid carbon dioxide pellets at rates ranging between 100 and 600 pounds per hour. The cryoblaster produces a spray of solid carbon dioxide pellets covering an area measuring approximately 2.5 cm by 13 cm. The cryoblaster is connected to a robot which is used to scan the cryoblaster in a controlled manner over the surface of the object. While scanning speeds vary from about 1 mm/sec to several thousand mm/sec, the recommended scanning speed is 120 mm/sec for the cryoblaster. This speed, combined with a delivery rate of at least 200 pounds per hour of solid carbon dioxide, results in nearly 100 percent pellet coverage for most areas being scanned.

As shown in FIG. 1, the equipment required for cryoblasting includes: liquid carbon dioxide storage 5, solid carbon dioxide particle maker 10, mechanical particle accelerator 15, air handling system 20*a* and 20*b*, which ensures that the work environment does not contain hazardous levels of carbon dioxide, a vacuum assisted accumulator for collecting contaminants removed from the fabric 25, and a fabric support means 30. Another suitable cryoblaster is the aforementioned one which accelerates the $CO_2$ particles by a compressed gas system, and cryoblasters which produce $CO_2$ particles by grinding blocks of solid $CO_2$. Particles may also be formed by an extrusion process in which solid $CO_2$ is forced through a die and pelletized.

In cryogenically cleaning industrial fabrics, pellet velocities and scanning rates are to be maintained within ranges that would not damage fabrics, since higher pellet velocities and/or lower scanning rates can lead to severe fabric damage.

In addition to conducting experiments on stained or soiled fabrics which had run in the field, trials were conducted on new or otherwise clean fabrics. Trials performed on new fabrics are useful in identifying operating conditions which will not damage the fabric. A list of the fabrics and example numbers is provided in Table 1.

TABLE 1

List of Fabrics Samples and Corresponding Example Numbers

| ID | New fabric Samples | Example |
|---|---|---|
| P1 | polyester (PET) woven fabric | 1 and 2 |
| P2 | polyester (PET) woven fabric | 3 |
| P3 | polyester (PET) woven fabric | 3 |
| P4 | polyester (PET) woven fabric | 3 |
| PCTA5 | polyester (PCTA) woven fabric (copolyester of 1,4-cyclohexane dimethanol terephthalate) fabric | 3 |
| PEEK6 | (polyetheretherketone) woven fabric | 3 |
| P7 | polyester (PET) woven fabric | 3 |
| P8 | polyester (PET) woven fabric | 3 |
| PN9 | polyester (PET)/nylon woven fabric | 3 |
| PN10 | polyester (PET)/nylon woven fabric | 3 |
| PN11 | polyester (PET)/nylon woven fabric | 3 |
| PT12 | polyester (PET) woven fabric coated with Teflon | 5 |
| P13 | polyester (PET) woven fabric | 5 |
| PPS14 | PPS (polyphenylenesulfide) fabric | 5 |
| PM15 | polyester/metal fabric (PET) | 6 |
| | Soiled Fabric Samples | Example |
| SPNF10 | Soiled polyester (PET)/nylon woven | 3, 4 |
| SPNF9 | Soiled polyester/nylon fabric | 4 |
| SPF16 | Soiled PET fabric | 4 |

TABLE 1-continued

| List of Fabrics Samples and Corresponding Example Numbers | | |
|---|---|---|
| SPNF11 | Soiled w/grease PET/nylon fabric | 4 |
| SPF17 | Soiled PET fabric | 4 |
| SNF18 | Soiled nylon fabric | 4 |
| SPNF19 | Soiled polyester/nylon fabric | 5 |
| SPTF20 | Soiled polyester fabric with Teflon coating | 5 |
| SPF21 | Soiled polyester fabric | 5 |
| SPNF11 | Soiled PET/nylon fabric | 5 |
| SPNF10 | Soiled PET/nylon fabric | 5 |
| SPNF9 | Soiled to PET/nylon fabric | 5 |
| SPF23 | Soiled polyester fabric | 5 |
| SPF24 | Soiled polyester fabric | 6 |
| SPF25 | Soiled polyester fabric | 6 |
| SPCTAF5 | Soiled polyester (copolyester of 1,4-cyclohexane dimethanol terephthalate) fabric | 6 |
| SPCTAF26 | Soiled polyester (copolyester of 1,4-cyclohexane dimethanol terephthalate) fabric | 6 |
| SPF28 | Soiled polyester fabric | 6 |
| SPF30 | Soiled polyester fabric | 6 |

EXAMPLE 1

Long strips of fabric measuring approximately 1.25 m by 15 cm were scanned with the fabric length oriented to the scanning direction. Fabric samples used in the following examples were obtained from the Albany International Corp. Dryer Fabrics Division, and the Albany International Corp. Engineered Fabrics Division, Greenville, S.C. and Portland Tenn., respectively. A 1.25 m length of PET woven fabric of design P1 fabric was scanned at a rate of 12 mm per second. The distance between the cryoblaster and the fabric surface was 70 mm. Carbon dioxide pellets were delivered at a rate of 422 pounds per hour. The fabric was scanned in such a way that the pellet velocity was ramped downward from 1150 feet per second to 383 feet per second over the length of the fabric.

After the fabric was subjected to cryoblasting, it was examined for damage. Pellet velocities of 766 feet per second or less appeared to produce no damage, while velocities above 766 feet per second resulted in the fibrillation of monofilaments in the fabric. At the highest velocities (1150 feet per second), the monofilaments were fibrillated that the backside of the fabric resembled that of a felt structure. Pellet velocity of 766 feet per second (8000 rpm) at a scanning rate of 12 mm/sec results in fabric damage to $P_1$ fabric.

EXAMPLE 2

Figure 2:
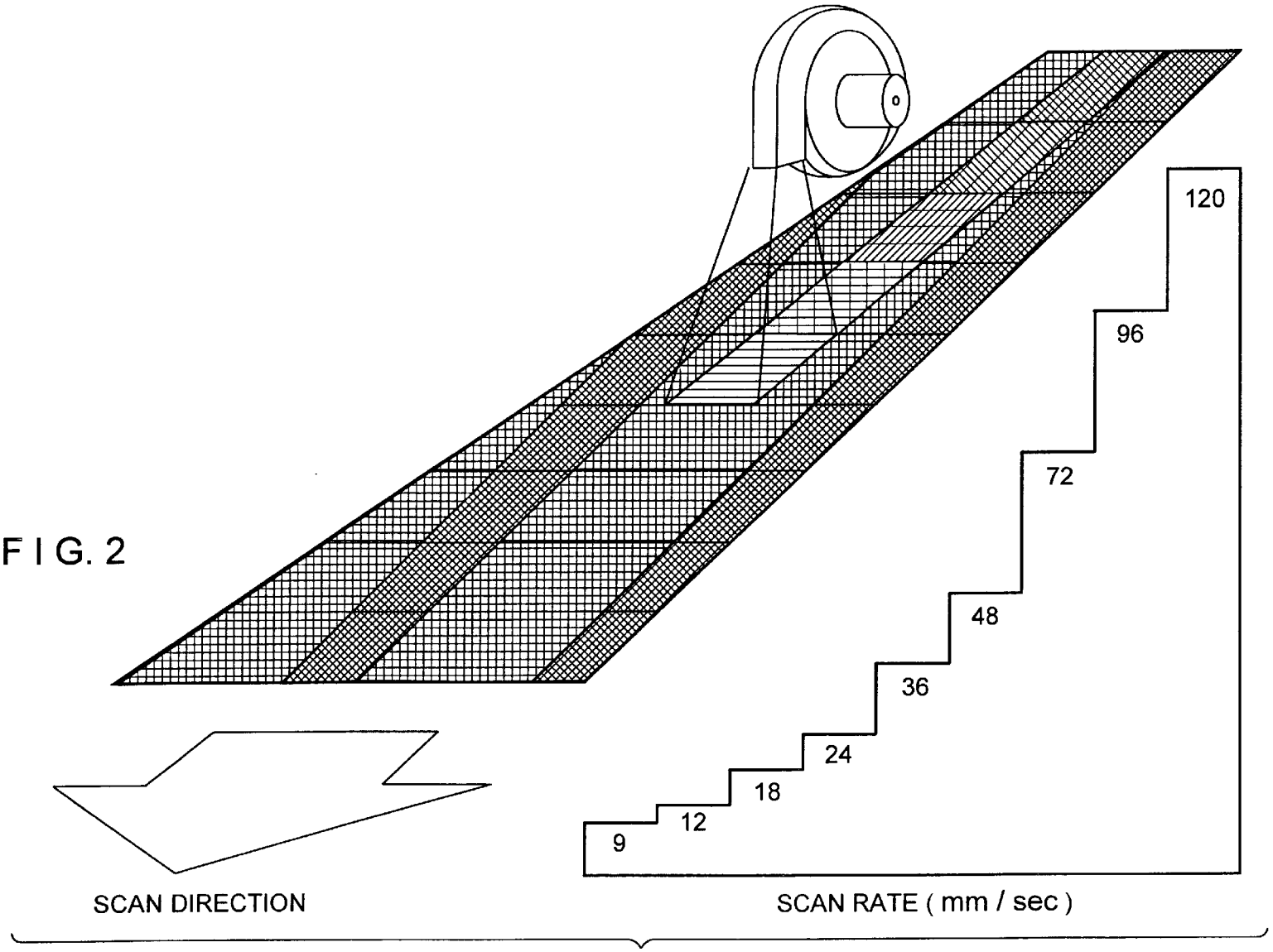
FIG. 2 depicts the process employed in example 2.

Scanning rate is another factor to consider. In this example, a sample of woven fabric of design P1 was subjected to cryoblasting at 8,000 rpm (766 feet per second). As in Example 1, long strips of the fabric measuring approximately 1.25 m by 15 cm were scanned with the fabric length oriented to the scanning direction. See FIG. 2. The scanning speed was varied via a step function providing scanning speeds of 120 mm per second, 96 mm per second, 72 mm per second, 48 mm per second, 36 mm per second, 24 mm per second, 18 mm per second, 12 mm per second, and 9 mm per second. For each scanning speed, a fixed length of 120 mm of fabric was cryoblasted. The solid carbon dioxide delivery rate for this experiment was 420 pounds per hour. Examination of the fabric showed that there was no damage to any piece of the fabric, including the portions scanned at the rate of 9 mm per second.

EXAMPLE 3

Figure 3:
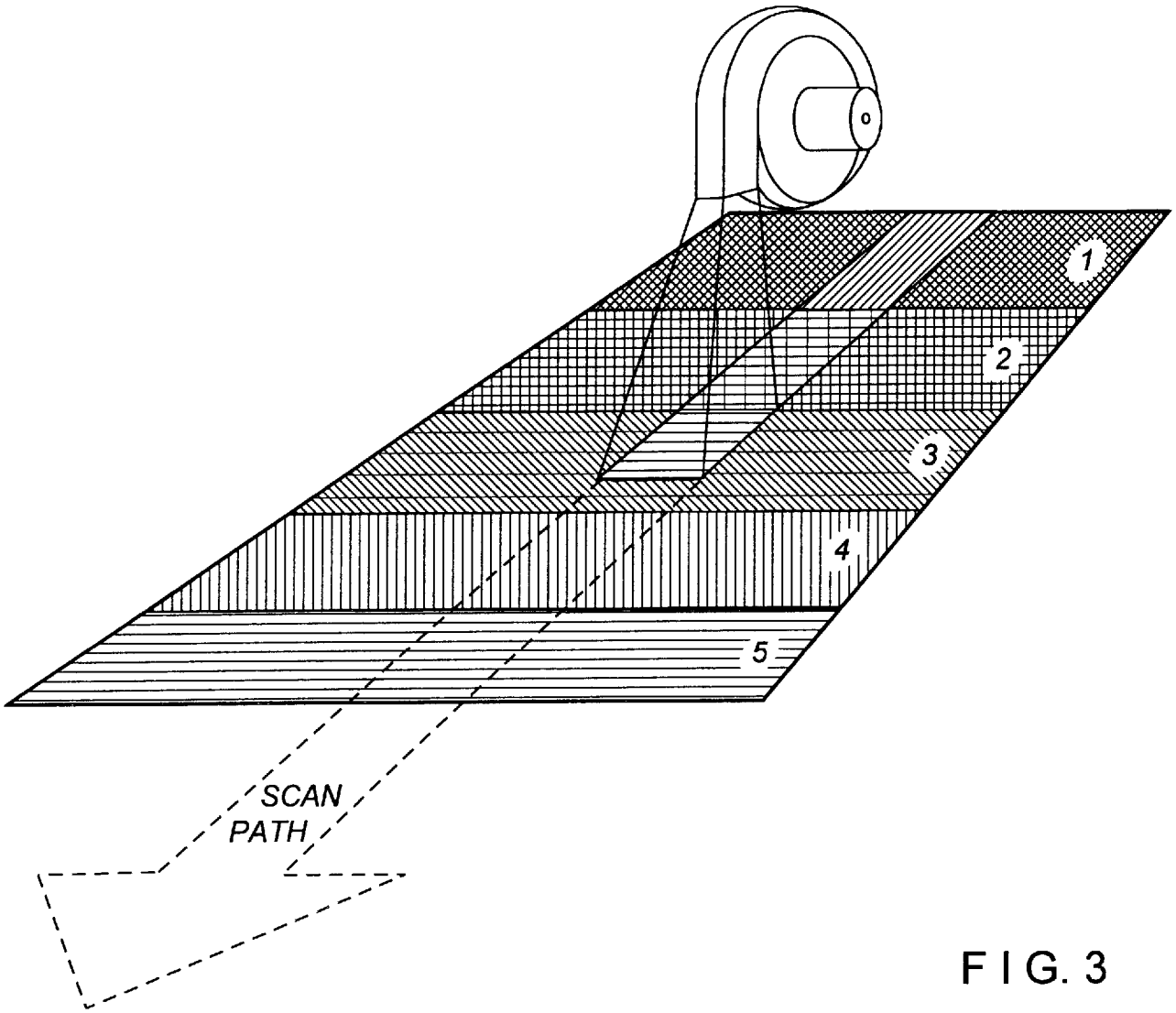
FIG. 3 depicts the process employed in example 3.
Figure 4A:
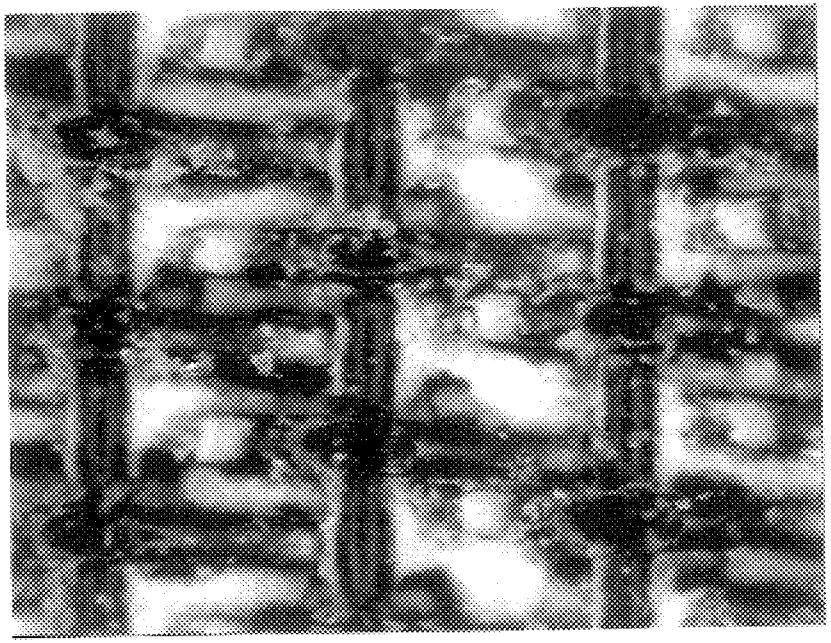
FIG. 4A is a photograph of fabric sample SPNF9 before treatment.
Figure 4B:
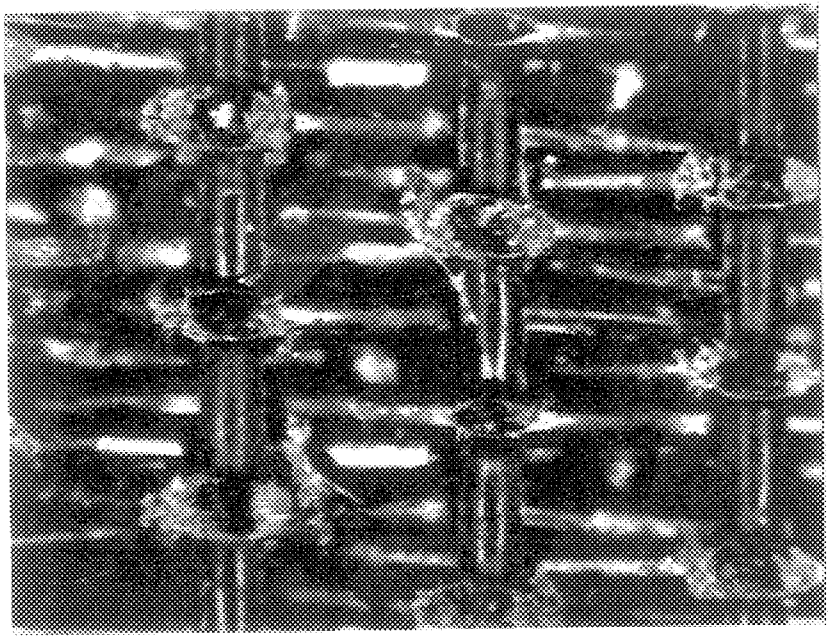
FIG. 4B is a photograph of fabric sample SPNF9 after treatment.
Figure 5A:
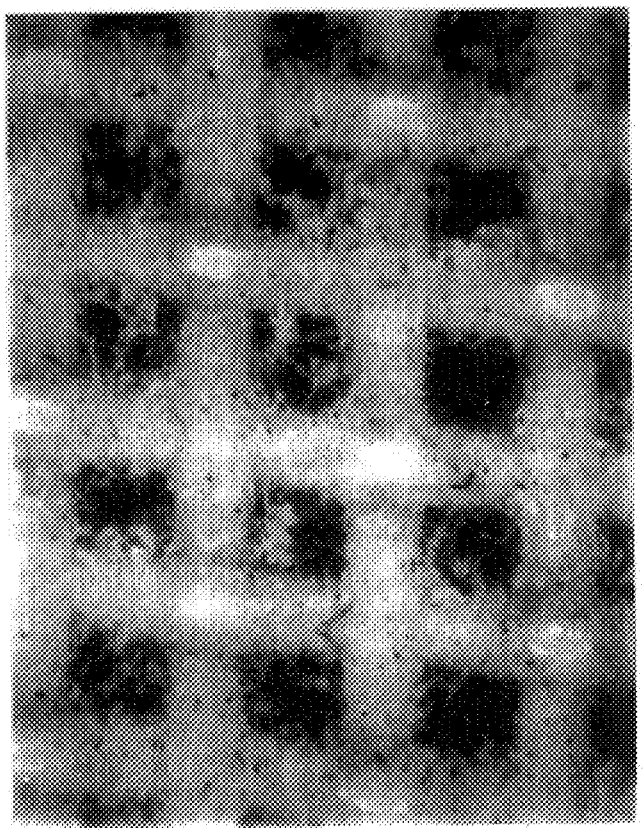
FIG. 5A is a photograph of fabric sample SPF16 before treatment.
Figure 5B:
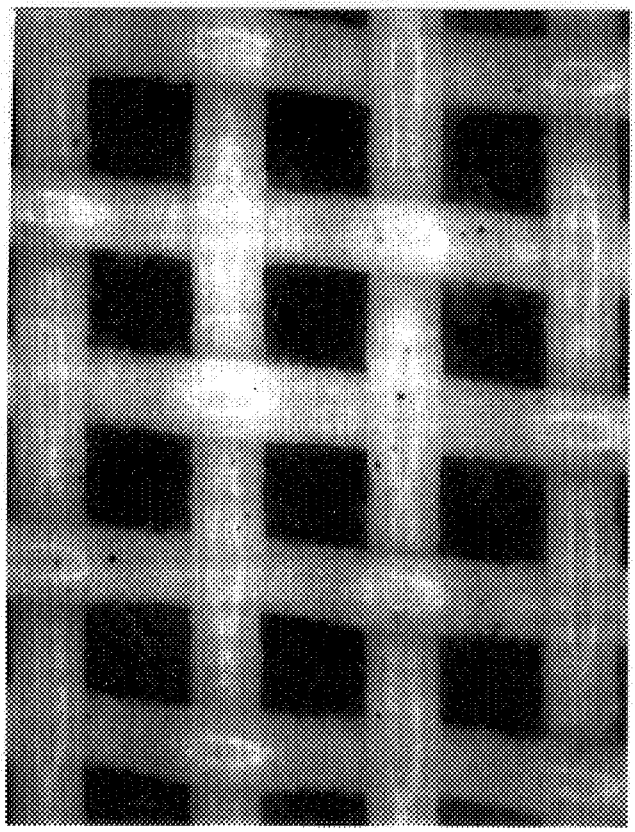
FIG. 5B is a photograph of fabric sample SPF16 after treatment.
Figure 6A:
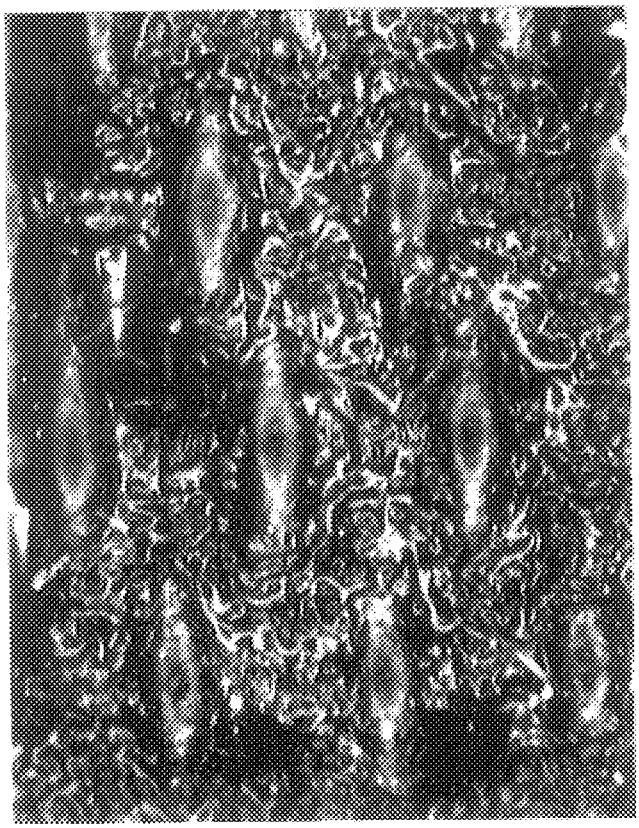
FIG. 6A is a photograph of fabric sample SPNF11 before treatment.
Figure 6B:
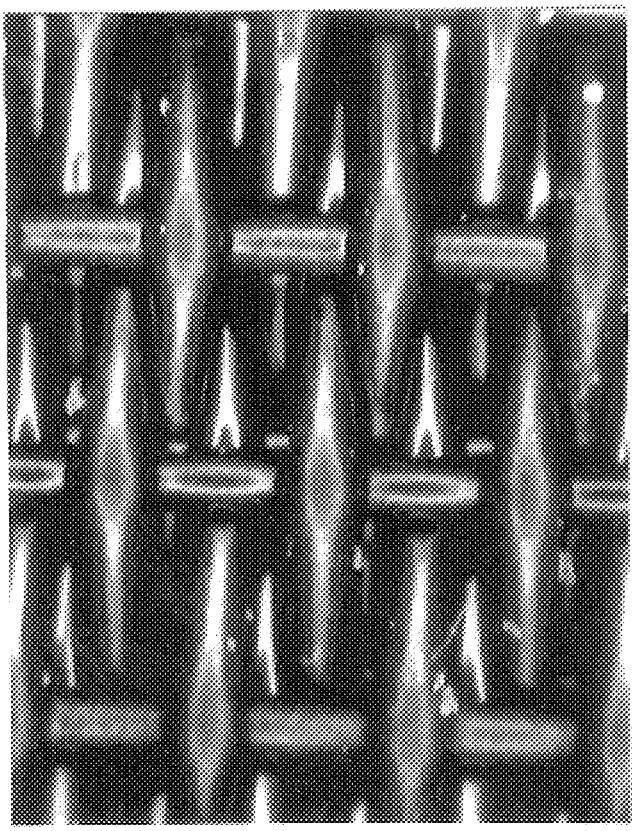
FIG. 6B is a photograph of fabric sample SPNF11 after treatment.
Figure 7A:
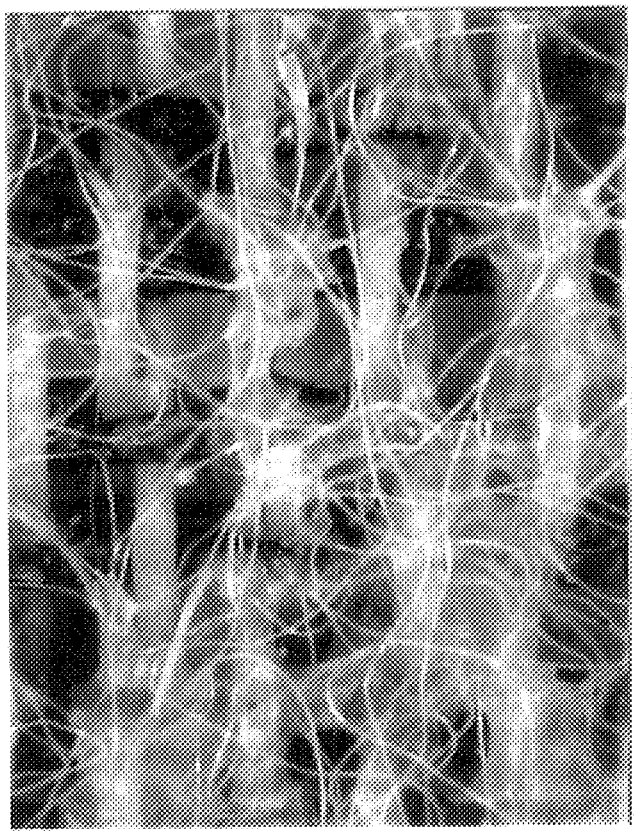
FIG. 7A is a photograph of fabric sample SPF17 before treatment.
Figure 7B:
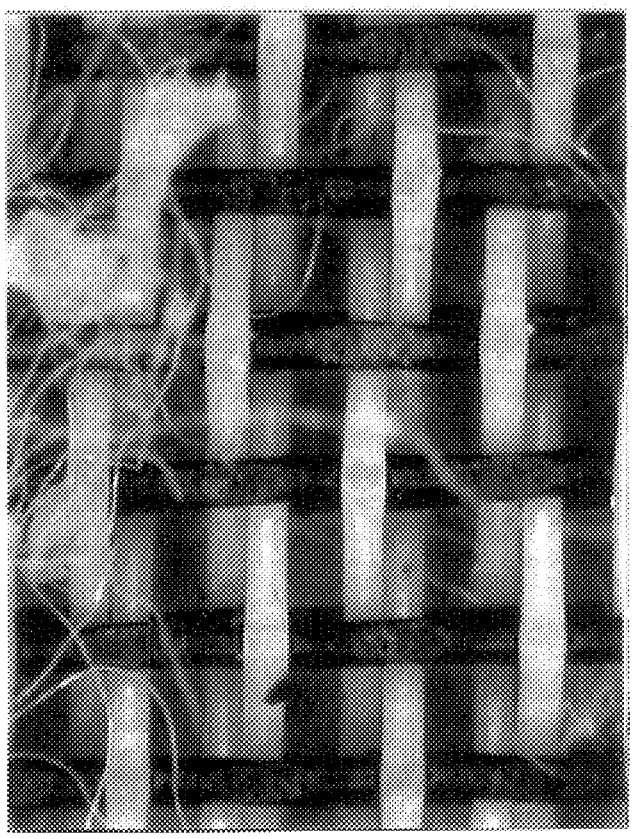
FIG. 7B is a photograph of fabric sample SPF17 after treatment.
Figure 8A:
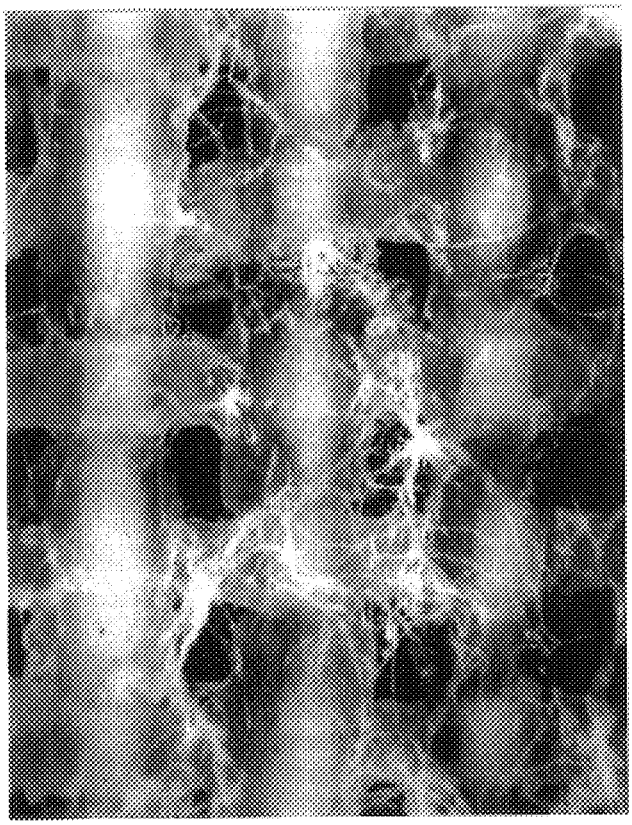
FIG. 8A is a photograph of the top of fabric sample SPNF19 before treatment.
Figure 8B:
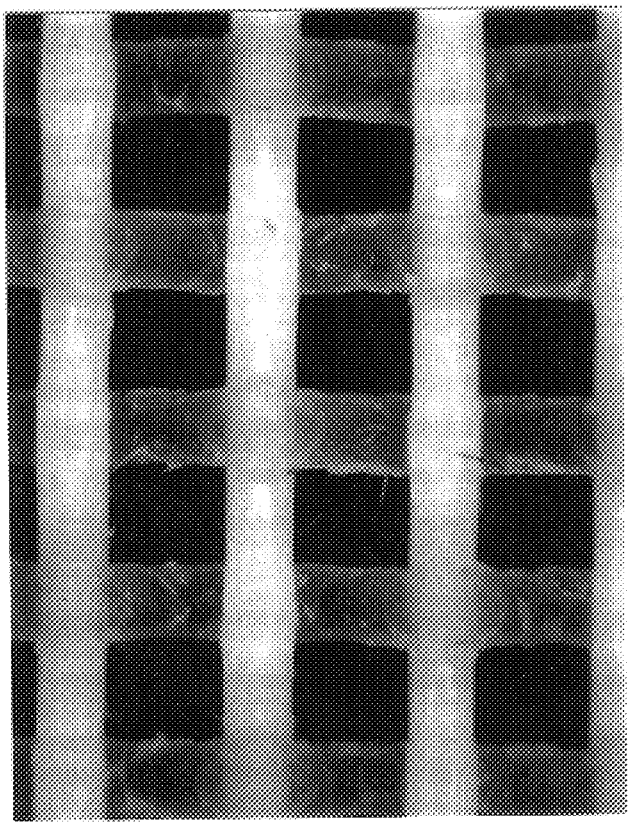
FIG. 8B is a photograph of the top of fabric sample SPNF19 after treatment.
Figure 9A:
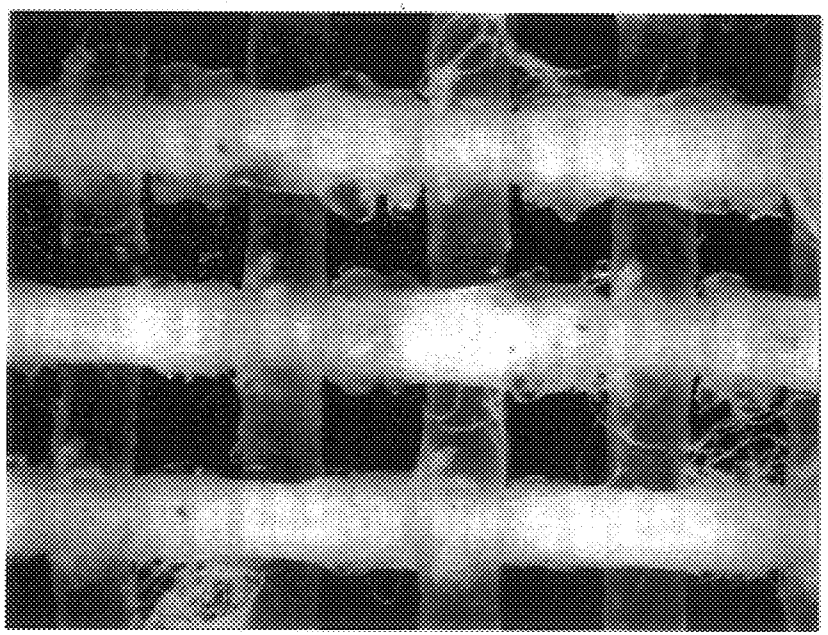
FIG. 9A is a photograph of the bottom of fabric sample SPNF19 before treatment.
Figure 9B:
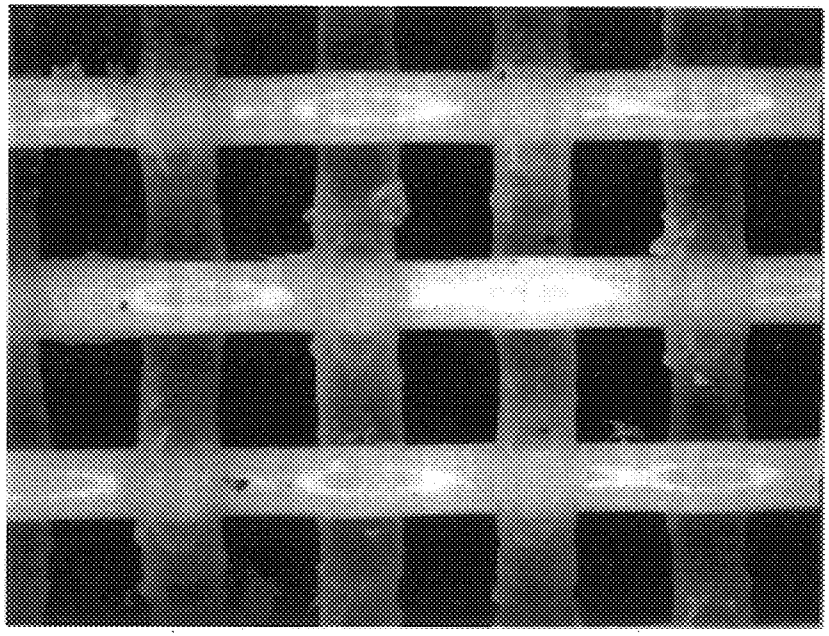
FIG. 9B is a photograph of the bottom of fabric sample SPNF19 after treatment.
Figure 10A:
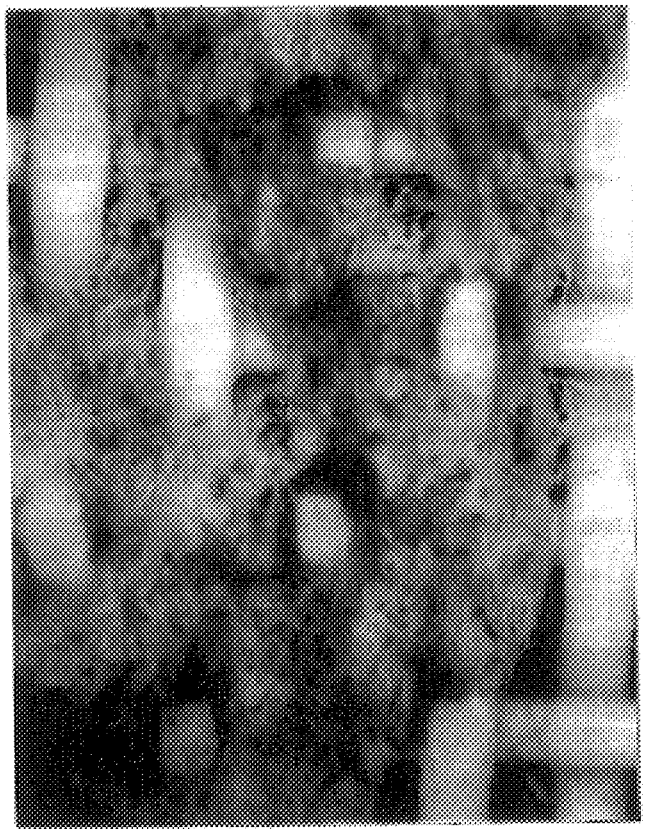
FIG. 10A is a photograph of the top of fabric sample SPF21 before treatment.
Figure 10B:
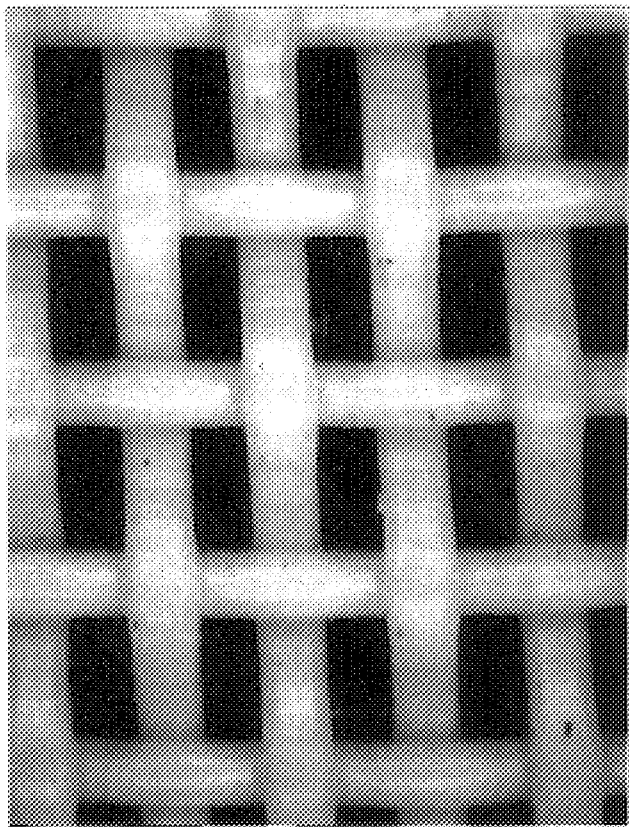
FIG. 10B is a photograph of the top of fabric sample SPF21 after treatment.
Figure 11A:
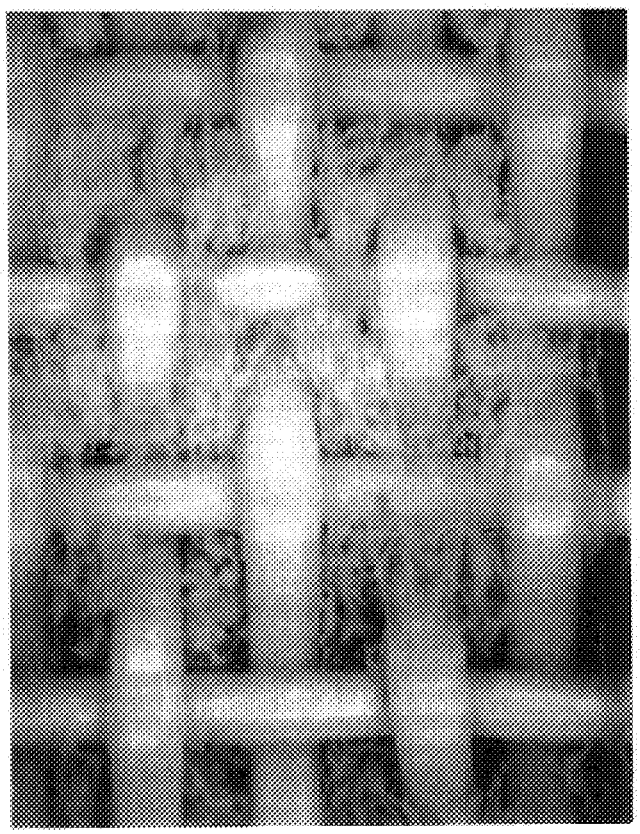
FIG. 11A is a photograph of the bottom of fabric sample SPF21 before treatment.
Figure 11B:
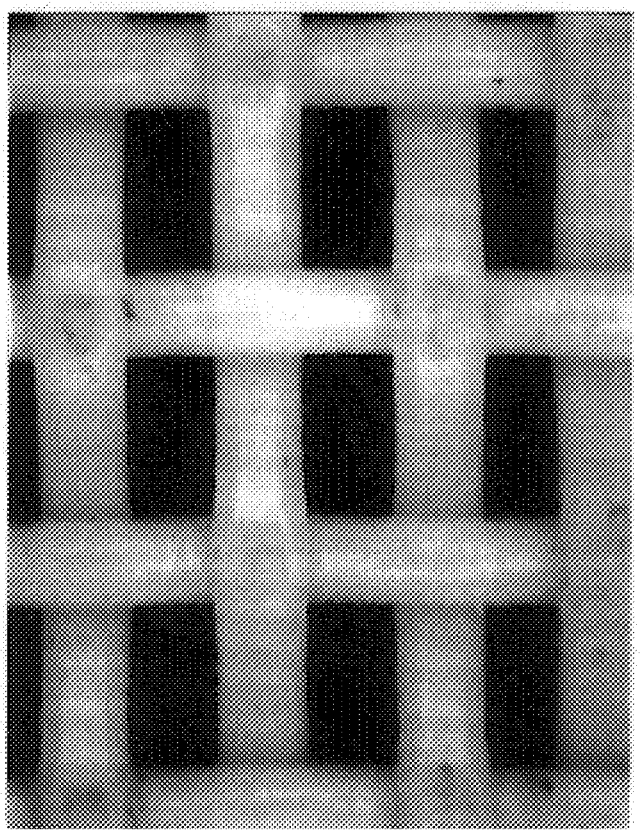
FIG. 11B is a photograph of the bottom of fabric sample SPF21 after treatment.
Figure 12A:
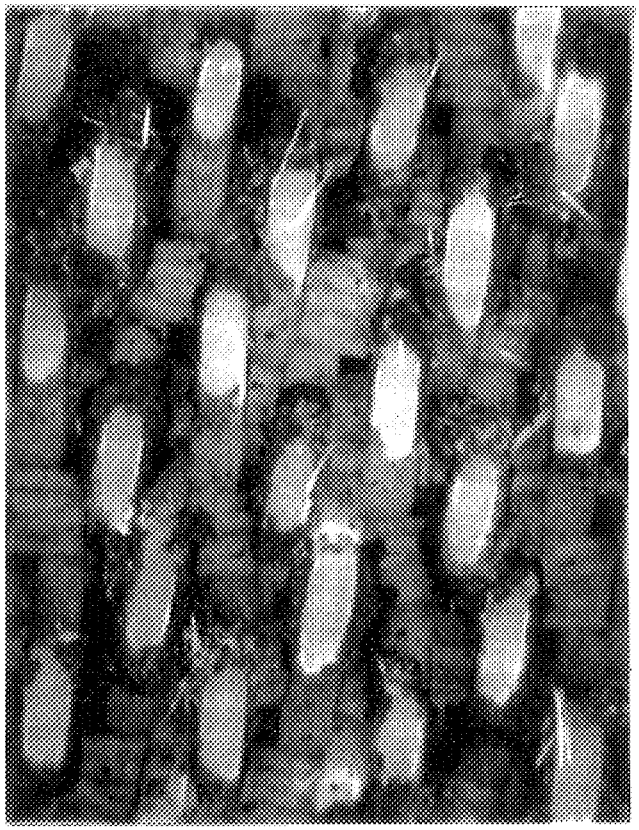
FIG. 12A is a photograph of fabric sample SPF24 before treatment.
Figure 12B:
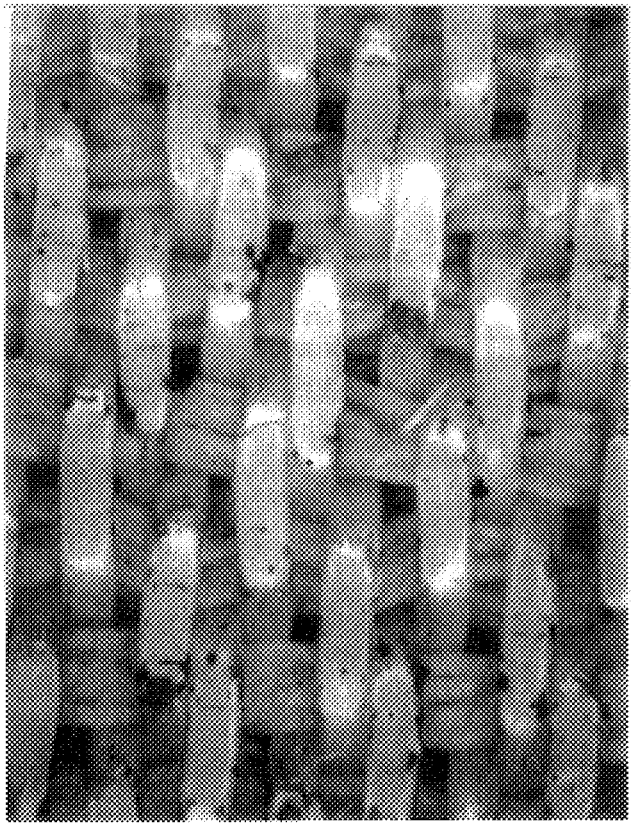
FIG. 12B is a photograph of fabric sample SPF24 after treatment.

Several fabric samples were cut into strips approximately 15 cm in width. These strips were laid down adjacent to each other with the length of the strips normal to the scanning direction. See FIG. 3. In this way, the robot and cryoblaster could scan several pieces of each fabric and a sequence of scanning trials could be conducted wherein a new portion of the fabrics could be exposed with each pass. In other words, the cryoblaster could scan a row of fabric samples in a single scan. With each scan, a portion of the fabric is subjected to cryoblasting, while a vast majority of the fabric sample is unaffected.

The cryoblasted area of each fabric measured approximately 13 cm by 15 cm, with the 13 cm dimension corresponding to the length of the stream of pellets produced by the cryoblaster. Fifteen centimeters corresponds to the cut width of the fabric samples. After one scan trial was completed, the fabrics were examined, new experimental conditions were determined, and a second scan was conducted on an unexposed portion of the fabric samples. After the second scan was conducted, fabric samples were examined and new scanning conditions were determined for a third scan. The scanning trials did not exceed four in total and in most cases were limited to two or three scanning trials.

Ten (10) samples of new fabrics were tested. The purpose of scanning new fabrics was to determine the relative levels of damage which might occur to the fabrics, based upon the material comprising the fabric or the structure of the fabric. The fabric samples consisted of PET woven fabrics P2, P3, P4, P7, P8, PET/nylon woven fabrics PN9, PN10, PN11, PCTA woven fabric PCTA5, PEEK woven fabric PEEK6.

The first scanning trial was conducted at a scanning rate of 6 mm per second and a pellet velocity of 766 feet per second (8,000 rpm). The pellet production rate was 256 pounds per hour.

The polyester woven fabric P2 exhibited warp and shute damage. The backside of the fabric exhibited a pattern corresponding to the pattern of the metal grid holding the fabric in place during the trial. PET woven fabric P3 exhibited damage where the metal grid supported the fabric. As with the first fabric, this produced a pattern of damage in the fabric which corresponded to the metal grid supporting the fabric. Polyester woven fabric P4 exhibited extensive damage. The warps were disintegrated leaving behind only the shute filaments. The PCTA woven fabric PCTA5 exhibited slight fracture in the warp strands. The PEEK woven fabric PEEK6 was undamaged. PET woven fabric P7 exhibited slight damage. PET woven fabric P8 exhibited light damage to the warp strands. PET/Nylon woven fabric PN9 exhibited damage to the polyester shutes. PET/nylon woven fabrics PN10 and PN11 exhibited damage to the warps. It has been found that the pattern of damage corresponding to the metal support in fabric designs P3 and P4 can be avoided by removing the metal grid and tensioning the fabric between two or more supports.

Based upon the results of the first scan, a second scan was conducted at a scanning rate of 120 mm per second. The rotational speed of the cryoblaster was maintained at 8,000 rpm (766 feet per second). The pellet production rate was 295 pounds per hour. After the second scan, PET woven fabric P2 and PET woven fabric P4 exhibited warp fibrillation where they were supported by the metal grid. All of the remaining fabrics were undamaged.

A third scan was conducted at a scanning rate of 120 mm per second. The cryoblaster was controlled to a speed of 6,000 rpm (575 feet per second). The pellet production rate was 185 pounds per hour. A new fabric sample was added to the group of ten fabrics bringing the total size of the group to 11 fabrics. This eleventh fabric was a soiled PET/nylon woven fabric SPNF10 which was the first soiled fabric sample to be subjected to cryoblasting in this trial. Cryogenic scanning did not result in damage to any of the fabric samples. The soiled PET/nylon woven fabric SPNF10 appeared to be cleaner in the area that had been scanned by the cryoblaster.

A fourth scan was conducted. This scan was conducted at a scanning speed of 6 mm per second with the cryoblaster operating at 6,000 rpm (575 ft/sec) and the pellet production at 187 pounds per hour. Fabric P2 exhibited light damage, fabric P3 exhibited damage where the fabric was supported by the metal grid, and fabric P4 had extensive damage. The remaining fabric samples appeared to be undamaged, except for the soiled PET/nylon woven fabric SPNF10 which exhibited a slight pattern of damage where the fabric was supported by the metal grid. The soiled PET/nylon woven fabric SPNF10 was considerably cleaner in the area which had been scanned.

From this example it would appear that a scan rate of 6 mm/sec and a pellet velocity of 766 ft/sec is generally unacceptable and damages most fabrics. However, results improve when the scan rate is maintained at 6 mm/sec while lowering pellet velocity, as most fabrics are undamaged.

It is noted that some instances of damage are due not to direct impact between the pellets and fabric, but are due to contact with the fabric and the backside metal support.

PET woven fabric P4 appeared to be particularly susceptible to damage when subjected to cryogenic treatment

EXAMPLE 4

A series of soiled fabrics were mounted for scanning trials in the manner of Example 3. These fabrics included PET/nylon woven fabrics SPNF9, SPNF10, SPNF11, PET woven fabrics SPF16, SPF17 and nylon woven fabric SNF18. These fabrics were obtained after running in the field during the production of paper and nonwoven products. For the first scan, the cryoblaster was operated at a speed of 6,000 rpm, [575 ft/sec] a scanning rate of 120 mm per second, and a pellet production rate of 184 pounds per hour. After the first scan, PET woven fabric SPF16 and PET/nylon woven fabric SPNF10 were observed to be cleaner. The rest of the fabrics were relatively unaffected by the cryoblasting treatment.

A second scan was performed over the same area as the first scan. The scanning rate was now changed to 12 mm per second. The cryoblaster speed was 6,000 rpm and the pellet production rate was 167 pounds per hour. After this scan, all of the fabrics appeared to be much cleaner.

Photographs showing the effect of cryoblasting on fabrics SPNF9, SPF16, SPNF11, SPNF10, and SPF17 are shown in FIGS. 4A, 4B, 5A, 5B, 6A, 6B, 7A, 7B, respectively, with the "A" photographs showing the fabrics before cleaning and the "B" photographs showing the fabrics after cleaning. It is evident from the photos that surface contaminants have been removed by the treatment and the fabrics are much cleaner as a result. SPNF11 is a PET/nylon fabric soiled with grease. The figures evidence that the treatment proved effective at grease removal.

PET woven fabric of design SPF17 was originally contaminated with fibers. See FIG. 7A. The fibers on this fabric have been raised from the surface of the fabric via cryoblasting. This produced a fuzzy surface on the fabric. We found that these fibers could be easily removed by grabbing the fibers and pulling them away from the surface of the fabric. After doing so, this area of the fabric was very clean.

A third scan was performed at a scanning rate of 36 mm/second on a new zone of the fabric samples. The cryoblaster was operated at 6,000 rpm and the pellet production rate was 180 pounds per hour. After this scan, all the fabric samples were cleaner. PET woven fabrics SPF16, SPF17 were very clean.

An image analysis of the surface of PET woven fabric SPF16 (FIGS. 5A and 5B) were made from the photographs of the two scans of the fabric surface before and after cryoblasting. These images were subjected to a Fourier transform to create a Fourier transform image. An inverse Fourier transform image was then created from the fourier transform image. Cross enhancement was then performed on the inverse Fourier transform image. This results in an image in which dirt particles are only visible and appear as white pixels. Counting the white pixels in each image (equal areas) and calculating the ratio of white pixels before and after cleaning yields a cleaning factor which is a quantitative measure of the cleaning effectiveness. The cleaning factor for PET woven fabric SPF16 was 14.5. This cleaning factor indicates that the fabric was contaminated to a level 14.5 times greater before cryoblasting than after cryoblasting.

EXAMPLE 5

The fabric samples subjected to cleaning via cryoblasting were: soiled PET/nylon fabrics SPNF9, SPNF10, SPNF11, new or unsoiled PET fabric coated with Teflon PT12, new or unsoiled PET woven fabric P13, new or unsoiled PPS fabric PPS14, soiled PET woven fabrics SPTF20, SPF21, and SPF23. On the first scan, the cryoblaster was operated at a speed of 6,000 rpm with a scanning rate of 12 mm per second and a pellet production rate of 178 pounds per hour. After the first scan, the contaminated fabric samples were cleaner. New PET woven fabric woven fabric P13 and new PPS woven fabric PPS14 were not damaged by cryoblasting except that new PET woven fabric P13 shows slight fiber damage in these areas where it was supported by the metal grid.

Photographs showing the effect of cryoblasting on selected samples are shown in FIGS. 8A, 8B, 9A, 9B, 10A, 10B, 11A and 11B. FIGS. 8A, 8B, 9A, and 9B show the cleaning effect of cryoblasting for fabric SPNF19. It is evident that the fabric is cleaner on its top and its bottom as a result of the treatment, even though it is treated on only the top side of the fabric.

As with Example 4, image analysis was performed to determine the cleaning factor for soiled PET woven fabric (SPF21, FIGS. 10A, 10B, 11A, and 11B). The cleaning factor for the top side of this fabric was 4.4. The figures show that the fabric is cleaner on both sides although it is treated only on the top side.

EXAMPLE 6

The following group of soiled fabrics of designs SPF24, SPF25, SPF30, SPF28, soiled PCTA woven fabrics SPCTAF5 and SPCTAF26, and new, unsoiled PET/metal fabric PM15 were treated as disclosed herein. The first scan was performed at a scanning rate of 12 mm per second and a cryoblaster speed of 6,000 rpm. The pellet production rate was 175 pounds per hour. After the first scan, all of the fabrics were substantially cleaner. Photographs showing fabric surfaces for samples before and after cryoblasting can be found in FIGS. 12A, 12B, 13A, 13B, 14A and 14B. Some debris on the fabric surface arose from fiber dust being blown onto the fabric from the air turbulence created by the cryoblaster. This dust is an artifact and is debris resulting from damage to fabrics subjected to severe cyroblasting conditions in this and prior examples. The fiber dust is easily removed by vacuum.

material was located on the surface of the filaments and not plugging spaces between the filaments. That is, these fabrics were not plugged.

It has been found that cryoblasting is very effective either on line at a paper mill (or similar facility) or off line at a facility for refurbishing soiled fabrics. Cryoblasting has potential to clean fabrics for effective recycling of raw materials used to produce the fabrics.

TABLE 2

Permeability Measurement Before and After Cryoblasting

| Fabric Sample ID | Permeability Before Cryoblasting | Permeability After Cryoblasting (CFM) | Comments |
|---|---|---|---|
| PET woven fabric (SPF28) | 89 | 139 | Plugged holes cleared |
| PCTA woven fabric (SPCTAF5) | 391 | 421 | No plugging; surface dirt |
| PET woven fabric (SPF30) | 425 | 336 | Material was hydrolyzed or degraded; cleaning fibrillated the monofilaments, plugged the fabric and decreased permeability |
| PET woven fabric (SPF25) | 84 | 88 | No plugging; surface dirt |
| PET woven fabric (SPF24) | 51 | 57 | No plugging; surface dirt |

Fabrics were cleaned with 1 pass (6 mm/s @ 6000 rpm).

PET woven fabric SPF30 was damaged by cryoblasting. This damage is probably related to prior hydrolysis of the PET fabric resulting in reduction of monofilament integrity. There was very slight damage to the unsoiled PET/metal fabric PM15. A second scan was performed at a cryoblaster speed of 6,000 rpm and a scanning rate of 6 mm per second. The pellet production rate was 161 pounds per hour. In this scan, all fabrics were scanned over a zone containing a soil. All of the soiled samples were considerably cleaner. PET woven fabric SPF30 was significantly damaged. PET/metal fabric PM15 exhibited slight damage to the warp.

Figure 13A:
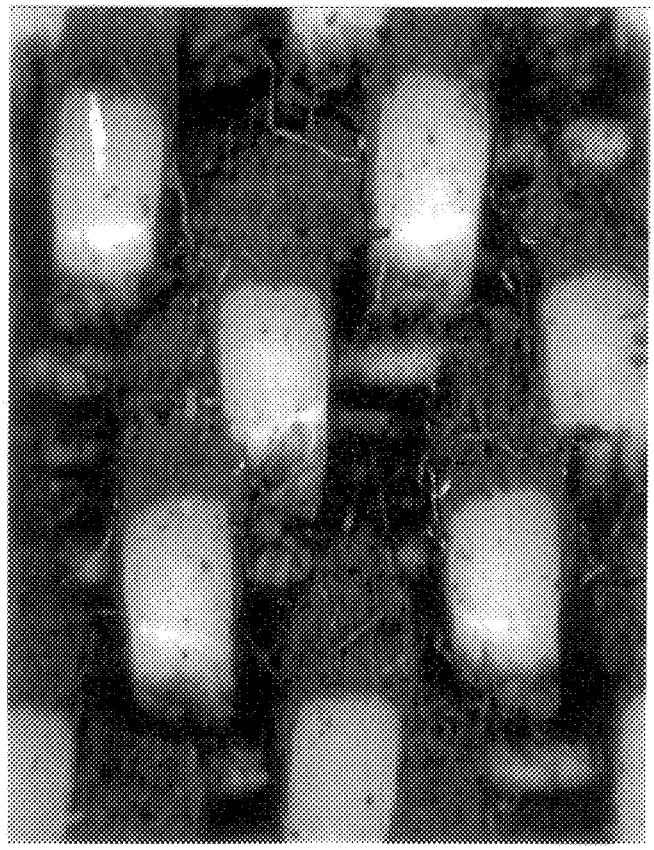
FIG. 13A is a photograph of fabric sample SPF28 before treatment.
Figure 13B:
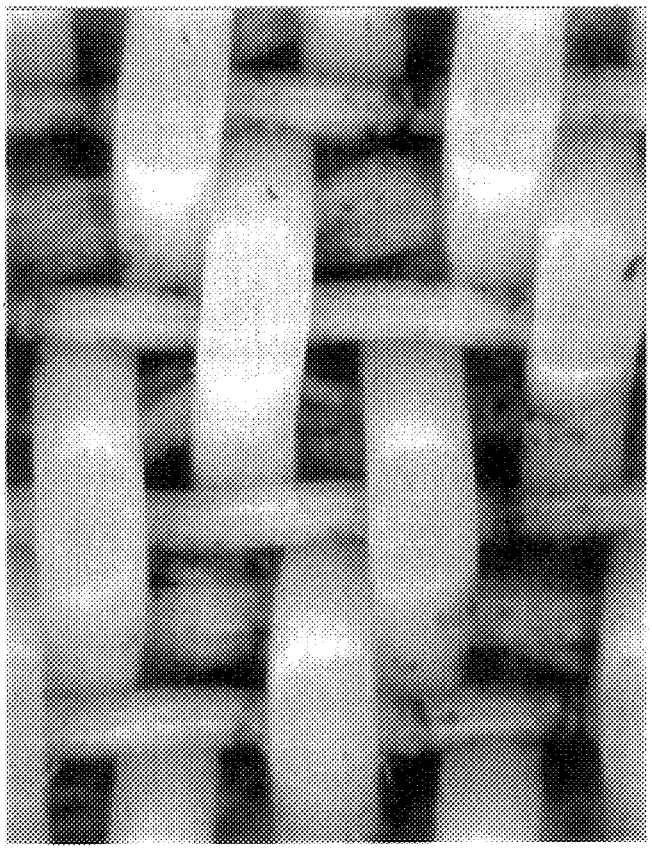
FIG. 13B is a photograph of fabric sample SPF28 after treatment.
Figure 14A:
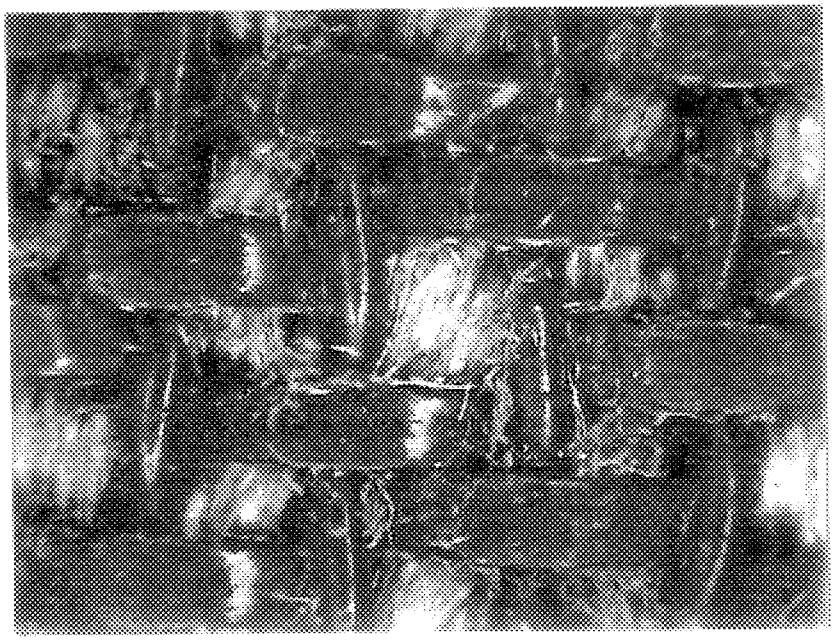
FIG. 14A is a photograph of fabric sample SPCTA26 before treatment.
Figure 14B:
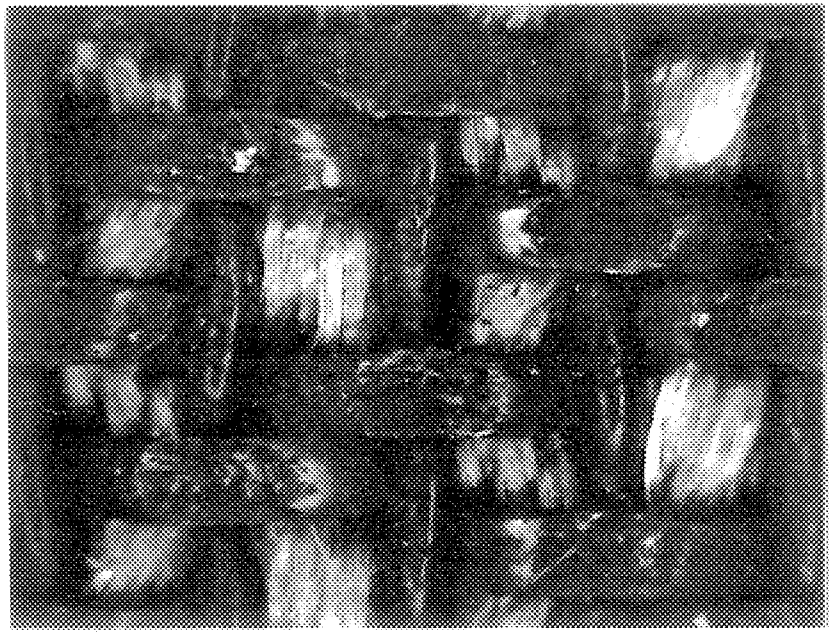
FIG. 14B is a photograph of fabric sample SPCTA26 after treatment.

As with Examples 4 and 5 image analysis was performed to determine the cleaning factor for soiled PET woven fabric SPF28, shown in FIGS. 13A, 13B. The cleaning factor for this fabric was 22.6.

Permeability measurements were made on each dryer fabric sample to compare permeability of dirty and clean areas. The results which are shown in Table 2. The permeability data presented in this table distinguishes between soiled fabrics that are plugged, and soiled fabrics that are not plugged. Where a fabric is not plugged, fabric only has dirt upon its surface, and the holes and interstices of the fabric are not filled with soil. The permeability reduction of fabrics soiled in this way relative to new fabrics is not noticeably large. However, when a fabric is plugged, the filling of the holes causes a substantial drop in permeability.

After cryoblasting, both plugged and unplugged fabrics exhibit an increase in permeability. However, the change in permeability for a plugged fabric is dramatic.

PET woven fabric SPF28 and (see FIGS. 13A, 13B) exhibits a much higher permeability after cleaning. This permeability increase appears to correspond with the photographs, wherein the treated fabric is observed as having a higher degree of openness. That is, FIGS. 13A and 13B show that the material that plugged the untreated fabric has been removed after cryoblasting. Other fabrics exhibit small increases in permeability, which is indicative that the soiling

We claim:

1. A process for removing contaminants from industrial process fabrics used in wet laid and dry laid processes comprised of the steps of impacting a surface of an industrial process fabric having contaminants on the surface with solid particles of carbon dioxide and removing the contaminants from the industrial process fabric.

2. The process as set forth in claim 1 wherein the impacting is effected by a device for generating solid particles of carbon dioxide and accelerating the particles towards the surface.

3. The process as set forth in claim 2 further comprised of scanning the device over the surface of the fabric in the course of impacting the surface with solid particles of carbon dioxide.

4. The process as set forth in claim 3 wherein the scanning over the surface of the fabric is selected to effect coverage of the entire surface of the fabric.

5. The process as set forth in claim 2 wherein the fabric is impacted with solid particles of carbon dioxide at preselected locations.

6. The process as set forth in claim 1 further comprised of selecting a velocity at which the solid particles of carbon dioxide impact the surface and do not damage the fabric.

7. The process as set forth in claim 6 wherein the velocity is less than 766 ft/sec.

8. The process as set forth in claim 1 wherein the removal of displaced contaminant is effected by carrying the contaminants away from the surface in a stream of gas.

9. A process as set forth in claim 1 wherein the contaminant is selected from the group consisting of cellulosic fibers, synthetic staple fibers, latex adhesives, olefinic polymer deposits, resin, pitch, tar, fillers, extenders, and starch residues.

10. A process for cleaning the surfaces and interstices of industrial process fabrics, the process comprising: impacting the inorganic and organic materials deposited on the surface of the fibrous components of industrial process fabrics during use in wet laid or dry laid processes, selected from a group consisting of cellulosic fibers, synthetic staple fibers, latex adhesives, olefinic polymer deposits, resin, pitch, tar, fillers, extenders, and starch residues with carbon dioxide particles to effect dislodgment and removal of the surface contaminants.

* * * * *